US012215708B2

(12) United States Patent
Cangioli et al.

(10) Patent No.: US 12,215,708 B2
(45) Date of Patent: Feb. 4, 2025

(54) TURBOMACHINE ROTOR WITH STACKED IMPELLERS AND TURBOMACHINE

(71) Applicant: NUOVO PIGNONE TECNOLOGIE—S.R.L., Florence (IT)

(72) Inventors: Francesco Cangioli, Florence (IT); Alberto Guglielmo, Florence (IT); Giuseppe Vannini, Florence (IT); Marco Formichini, Florence (IT); Massimiliano Tempestini, Florence (IT); Dario Matina, Florence (IT)

(73) Assignee: Nuovo Pignone Tecnologie—S.R.L., Florence (IT)

( * ) Notice: Subject to any disclaimer, the term of this patent is extended or adjusted under 35 U.S.C. 154(b) by 0 days.

(21) Appl. No.: 18/556,607

(22) PCT Filed: Apr. 25, 2022

(86) PCT No.: PCT/EP2022/025179

§ 371 (c)(1),
(2) Date: Oct. 20, 2023

(87) PCT Pub. No.: WO2022/228727

PCT Pub. Date: Nov. 3, 2022

(65) Prior Publication Data

US 2024/0200567 A1 Jun. 20, 2024

(30) Foreign Application Priority Data

Apr. 28, 2021 (IT) ..... 102021000010781

(51) Int. Cl.
*F04D 29/28* (2006.01)
*F01D 5/04* (2006.01)
*F04D 17/12* (2006.01)
*F04D 29/054* (2006.01)

(52) U.S. Cl.
CPC ..... *F04D 29/286* (2013.01); *F01D 5/04* (2013.01); *F04D 17/122* (2013.01); *F04D 29/054* (2013.01)

(58) Field of Classification Search
CPC ..... F01D 5/06; F04D 17/12; F04D 17/122; F04D 29/286; F04D 29/054
See application file for complete search history.

(56) References Cited

U.S. PATENT DOCUMENTS

| | | | |
|---|---|---|---|
| 3,680,979 | A | 8/1972 | Hansen et al. |
| 4,037,404 | A | 7/1977 | Bougain |
| 6,250,883 | B1 | 6/2001 | Robinson |

(Continued)

FOREIGN PATENT DOCUMENTS

| | | | |
|---|---|---|---|
| EP | 1970528 | A1 | 9/2008 |
| WO | 2016/060686 | A1 | 4/2016 |

*Primary Examiner* — Sabbir Hasan
*Assistant Examiner* — Jackson N Gillenwaters
(74) *Attorney, Agent, or Firm* — Paul Frank + Collins P.C.

(57) ABSTRACT

The rotor comprises a plurality of rotor segments arranged axially adjacent to one another. A tie rod extends through the rotor segments. Opposed first and second locking members arranged at the axial ends of the tie rod lock the rotor segments to one another and to the tie rod. At least one intermediate support member is arranged in an intermediate position between the two axial ends of the tie rod and between the tie rod and one of the rotor segments.

10 Claims, 5 Drawing Sheets

(56) References Cited

U.S. PATENT DOCUMENTS

| | | | | |
|---|---|---|---|---|
| 7,553,123 | B2 * | 6/2009 | Casaro | F04D 19/04 384/536 |
| 7,828,512 | B2 * | 11/2010 | Eilers | F04D 29/0563 415/199.5 |
| 9,903,374 | B2 * | 2/2018 | Kosamana | F04D 29/624 |
| 10,731,468 | B2 * | 8/2020 | Han | F01D 25/12 |
| 2015/0198044 | A1 * | 7/2015 | Jung | F01D 5/10 416/96 R |
| 2018/0135416 | A1 | 5/2018 | Han | |
| 2018/0266433 | A1 * | 9/2018 | Iurisci | F04D 29/30 |
| 2023/0175513 | A1 * | 6/2023 | Kuzdzal | F04D 17/122 415/198.1 |

* cited by examiner

TURBOMACHINE ROTOR WITH STACKED IMPELLERS AND TURBOMACHINE

TECHNICAL FIELD

Embodiments of the subject matter disclosed herein relate to rotors for turbomachines including a plurality of impellers, as well as to turbomachines comprising said rotors.

Background Art

Several turbomachines include a rotor comprised of a plurality of rotor segments assembled together. For instance, centrifugal compressors comprise a rotor including a plurality of impellers arranged in sequence along the rotation axis of the rotor.

Impellers can be assembled in various ways. One way of assembling the impellers consists in shrink-fitting the impellers on a shaft. This assembling technology has some drawbacks, mainly due to the fact that at high rotational speeds the impellers expand radially due to the centrifugal force acting thereon. This may lead to loosening of the shrink-fit connection between the impeller and the rotation shaft. Use of shrink-fit impellers is therefore limited to relatively slow-rotating turbomachines and/or to small impellers.

In order to achieve higher rotational speeds with larger impellers, so-called stacked configurations are used. In this case, each impeller is provided with an axial through bore. The impellers are stacked axially adjacent to one another and an axial tie rod is introduced through the bores of the stacked impellers. The tie rod protrudes axially from the first impeller and from the last impeller, such that an axial force can be applied to the first impeller and last impeller by means of the tie rod to tightly hold all the impellers together. The mutually stacked impellers are provided with front couplings, such as Hirth couplings, to torsionally connect the impellers to one another.

Stacked impellers are beneficial in high-speed turbomachines, but still suffer from some limitations. Specifically, the axial length of the tie rod and/or the operative rotational speed of the turbomachine including it cannot be selected at will. The tie rod, as any rotational component of a rotary machine, is characterized by own resonance frequencies. The operating rotary speed of the turbomachine cannot be equal to or higher than the first resonance frequency of the tie rod. In order to increase the rotational speed of the turbomachine, shorter tie rods must be used, which poses a limitation to the number of impellers that can be mounted on the same tie rod. The small number of impellers stackable on the same rotor in turn limits the compression ratio that can be achieved with a single compressor. If higher compressor ratios are needed, two or more compressors must be arranged in sequence. This increases costs and footprint of the compression arrangement.

EP-1970528 discloses a turbine rotor including a plurality of impellers arranged axially adjacent to one another and a tie rod extending through bores of the impellers. Opposed first locking member and second locking member arranged at the first axial end and second axial end of the tie rod lock the impellers to one another and to the tie rod. In order to reduce the vibration of the tie rod during rotation of the turbine rotor, an intermediate support member is arranged in the through bore of one of the impellers, in an intermediate position of the rotor. The intermediate support member consists of a plurality of separate mechanical components combined to one another. Specifically, the intermediate support member comprises an inner annular component, which is shrink-fitted on the tie rod, and a plurality of outer components, which are arranged circumferentially around the inner annular component. Each outer component is resiliently biased by radial and tangential springs against the inner surface of the through bore of the impeller, in which the intermediate support member is housed. The springs are pre-loaded such that the outer components are permanently biased against the inner surface of the through bore of the intermediate impeller and the tie rod is resiliently supported in the bore at any rotary speed of the turbine rotor, as well as when the rotor is at stillstand.

Assembling of the intermediate support member in the rotor is a complex and time-consuming operation.

SUMMARY

In order to solve or alleviate one or more of the drawbacks of the prior art turbomachine rotors, in some embodiments of the present disclosure a rotor for a turbomachine is provided, which comprises a plurality of rotor segments arranged axially adjacent to one another, each rotor segment including a central through bore or hole. A tie rod extends through the bores of the rotor segments and axially projects with opposite first axial end and second axial end from the first rotor segment and last rotor segment. Opposed first locking member and second locking member are arranged at the first axial end and second axial end of the tie rod and adapted to lock the rotor segments to one another and to the tie rod. To increase the first resonance frequency of the tie rod, at least one intermediate support member is arranged in an intermediate position between the first axial end and the second axial end of the tie rod and between the tie rod and one of the rotor segments. The intermediate support member comprises an inner annular component and an outer annular component, the latter being formed by a plurality of annular segments. Each annular segment is resiliently coupled to the inner annular component by at least one resilient member arranged between the inner annular component and the respective annular segment. The inner annular component, the annular segments of the outer annular component and the resilient members are formed as a monolithic machine component, for instance by additive manufacturing.

Mounting of the intermediate support member in the rotor is simple and fast. The intermediate annular member is fitted on the tie rod. The resilient members of the intermediate support member are not preloaded, such that the tie rod with the intermediate support member press-fitted thereon can be simply introduced into the axial through bores of the stacked rotor members. The annular segments will expand and co-act with the inner surface of the bore housing the intermediate support member only when the rotor is driven into rotation and the outer annular segments expand under the effect of centrifugal force. Co-action between the bore and the outer annular segments is established before the first critical (resonance) speed of the tie rod is achieved, such that the critical speed is increased.

In order to further facilitate the assembly of the rotor, according to embodiments disclosed herein, at rest, i.e. at zero rotational speed of the rotor, the outer diameter of the outer annular component is smaller than an inner diameter of the bore in which the intermediate support member is housed. When the rotor is driven into rotation, the annular segments expand and press against the inner surface of the bore housing the intermediate support member.

Longer tie rods and/or higher rotational speeds of the rotor are thus possible, without the risk of operating the rotor near the first critical (resonance) frequency of the tie rod.

Features and embodiments of the rotor and of the turbomachine including the rotor are described in greater detail in the following description, reference being made to the enclosed drawings, which show exemplary embodiments of the rotor and of the turbomachine.

BRIEF DESCRIPTION OF THE DRAWINGS

Reference is now made briefly to the accompanying drawings, in which.

DETAILED DESCRIPTION

To increase the stiffness of a tie rod in a turbomachine rotor having an arrangement of stacked impellers, at least one intermediate support member is provided between the tie rod and one of the elements forming the turbomachine rotor. The intermediate support member increases the first resonance frequency of the tie rod such that the rotor can rotate at higher operational speeds without the risk of resonance phenomena arising in the tie rod. Higher rotational speeds with a larger number of impellers on the same tie rod can thus be achieved, which is particularly beneficial when processing low-molecular weight gases, such as hydrogen, for instance and/or high compression ratios are desired.

Figure 1:
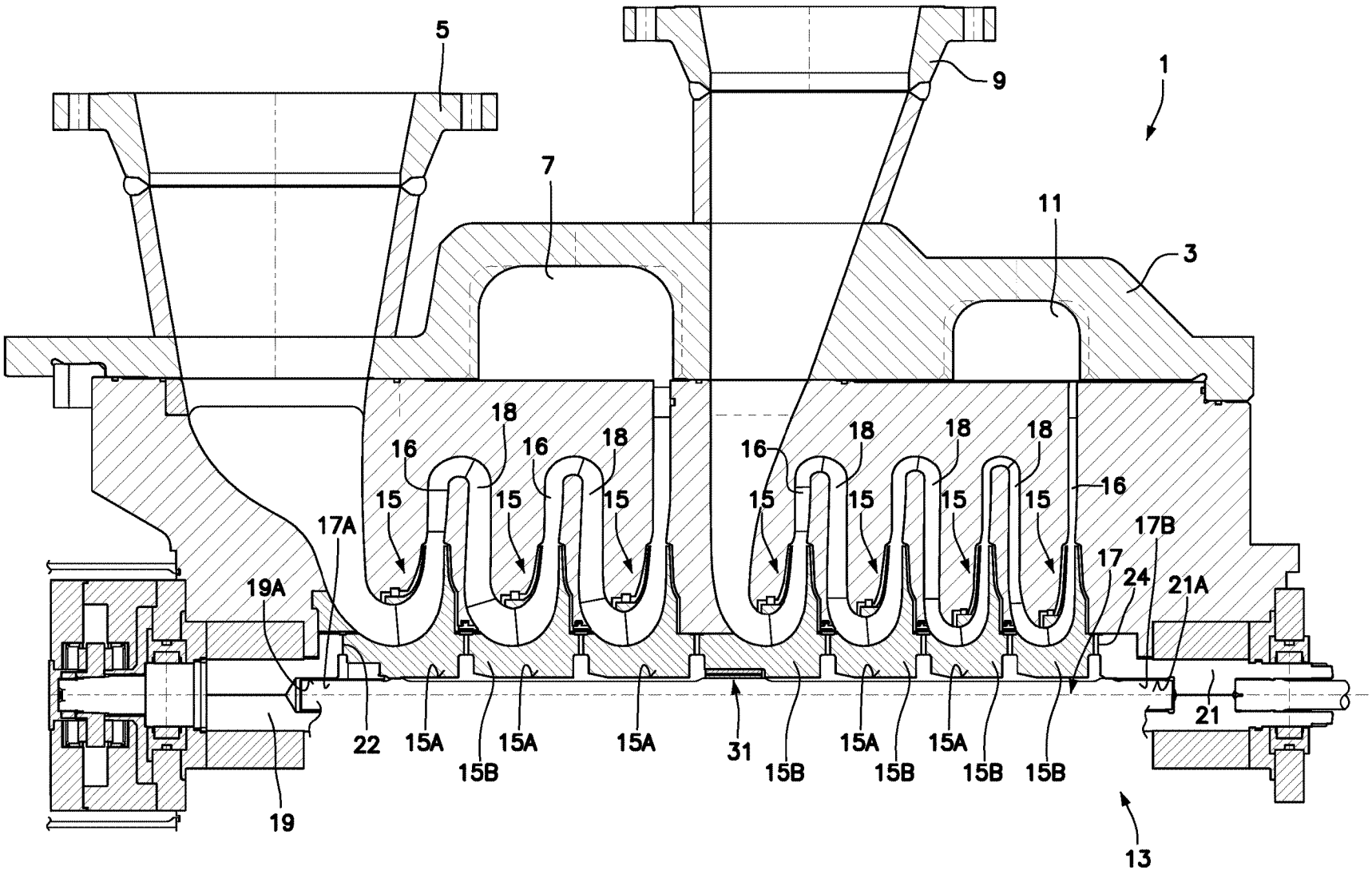
FIG. 1 is a sectional view of a centrifugal compressor according to one embodiment.

Turning now to the drawings, FIG. 1 illustrates a sectional view of a centrifugal compressor 1 according to embodiments. The centrifugal compressor 1 comprises a casing 3 having a first gas inlet 5, a first gas outlet 7, a second gas inlet 9 and a second gas outlet 11. In other embodiments, not shown, the centrifugal compressor may have a single gas inlet and a single gas outlet. When two inlets and two outlets are provided, intercooling of the partially compressed gas can be foreseen, to increase the compressor efficiency.

The centrifugal compressor 1 further includes a rotor 13 arranged for rotation in the casing 3. The rotor 13 comprises a plurality of rotor segments arranged axially adjacent to one another. In the embodiment of FIG. 1, the rotor segments include a plurality of centrifugal compressor impellers 15. The centrifugal compressor 1 of FIG. 1 comprises seven impellers 15. It shall be understood that the number of impellers as well as their arrangement can be different. For instance, more than seven impellers or less than seven impellers can be arranged along the rotor 13.

In the embodiment of FIG. 1, the impellers 15 are arranged in an in-line configuration, in an upstream-to-downstream sequence, the lowest pressure impeller being arranged on the left side of the compressor 1 and the highest-pressure impeller being arranged on the right side of the compressor 1 looking at the drawing.

In the embodiment of FIG. 1, the impellers are grouped in a first compressor section including three impellers and a second compressor section including four impellers. The first compressor section receives gas at a lower pressure through the first gas inlet 5 and delivers gas at an intermediate pressure through the first gas outlet 7. Partially pressurized gas at the intermediate pressure enters the second compressor section through the second gas inlet 9 and is delivered at a final delivery pressure through the second gas outlet 11. An intercooler can be fluidly coupled between the first gas outlet 7 and the second gas inlet 9.

Each impeller 15 co-acts with a respective diffuser 16 and can be fluidly coupled to a respective downstream impeller through a return channel 18.

The rotor 13 further comprises a tie rod 17 which extends through each through bore 15A provided in a respective hub 15B of each impeller 15. The tie rod 17 has a first axial end 17A and a second axial end 17B.

In embodiments, the first axial end 17A and the second end 17B are threaded and co-act with a first stub shaft 19 and a second stub shaft 21, respectively. The first stub shaft 19 can have a threaded blind hole 19A, in which the first end 17A of the tie rod 17 is engaged. The second stub shaft 21 can have a threaded blind hole 21A, in which the second threaded end 17B of the tie rod 17 is engaged. The first stub shaft 19 and the second stub shaft 21 form or are part of opposed first locking member and second locking member.

The tie rod 17 can thus be put under tension by screwing the two stub shafts 19, 21 to the two ends 17A, 17B of the tie rod 17. The two stub shafts 19, 21 press the stacked impellers 15 one against the other in a stacked configuration.

In embodiments, the impeller hubs 15B can be provided with front couplings which rotationally lock each impeller with the adjacent ones and with the stub shafts 19, 21. In some embodiments, the front couplings include respective Hirth couplings 23 (see in particular enlargement of FIG. 2), which lock the impellers against mutual rotation around the axis A-A of the rotor, such that the impellers 15, the tie rod 17 and the to stub shafts 19, 21 form together a single rotor body, adapted to rotate around the rotation axis A-A. A respective Hirth coupling 22, 24 can further be provided between each stub shaft 19, 21 and the adjacent impeller 15.

While a Hirth coupling provides a particularly efficient torsional coupling between mutually stacked impellers 15, the use of a different front coupling or joint is not excluded.

An intermediate support member 31 is mounted in an intermediate position along the axial extension of the tie rod 17. In some embodiments, the intermediate support member 31 can be press-fit or keyed on the tie rod 17.

Figure 2:
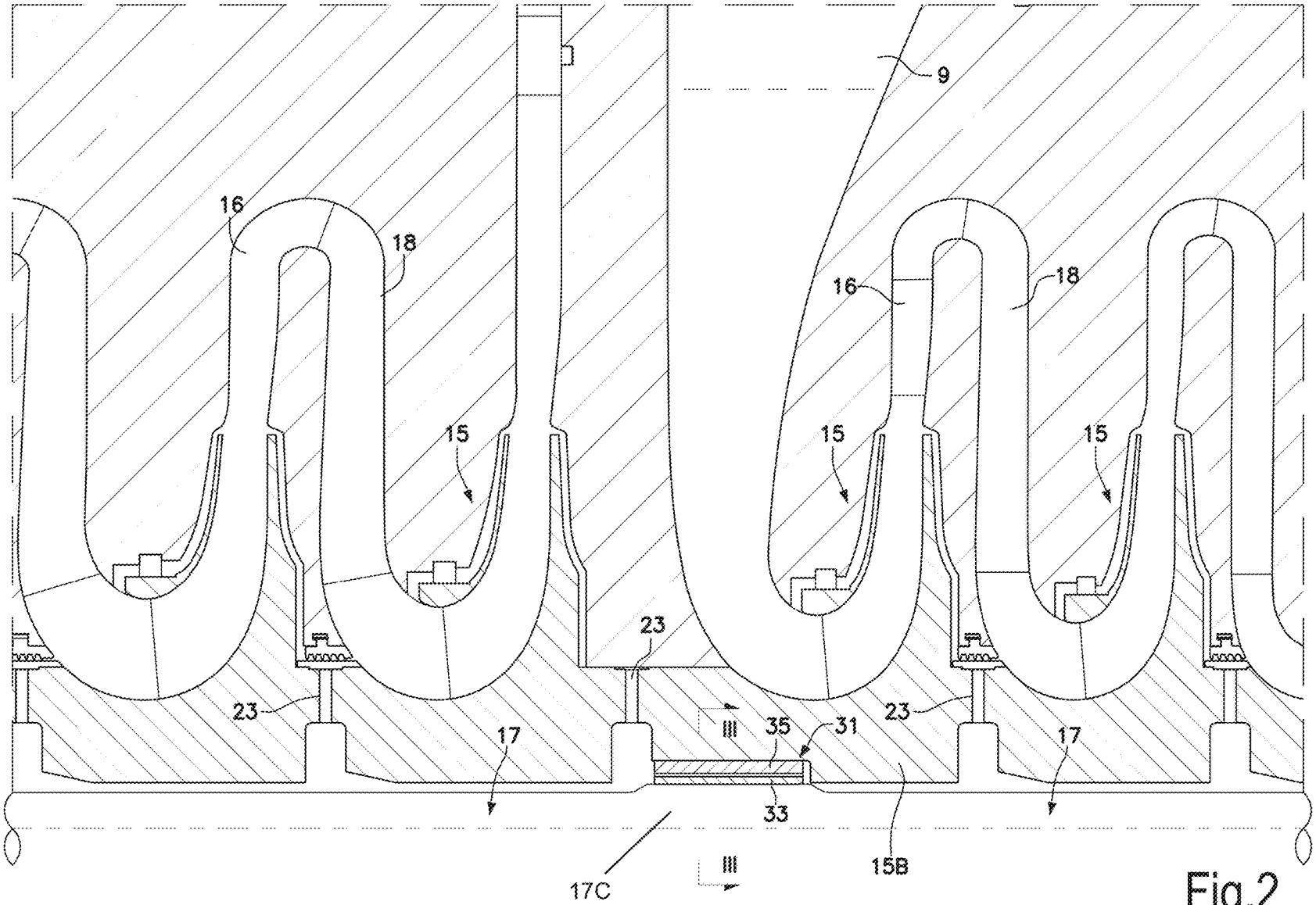
FIG. 2 is an enlarged detail of FIG. 1.
Figure 3:
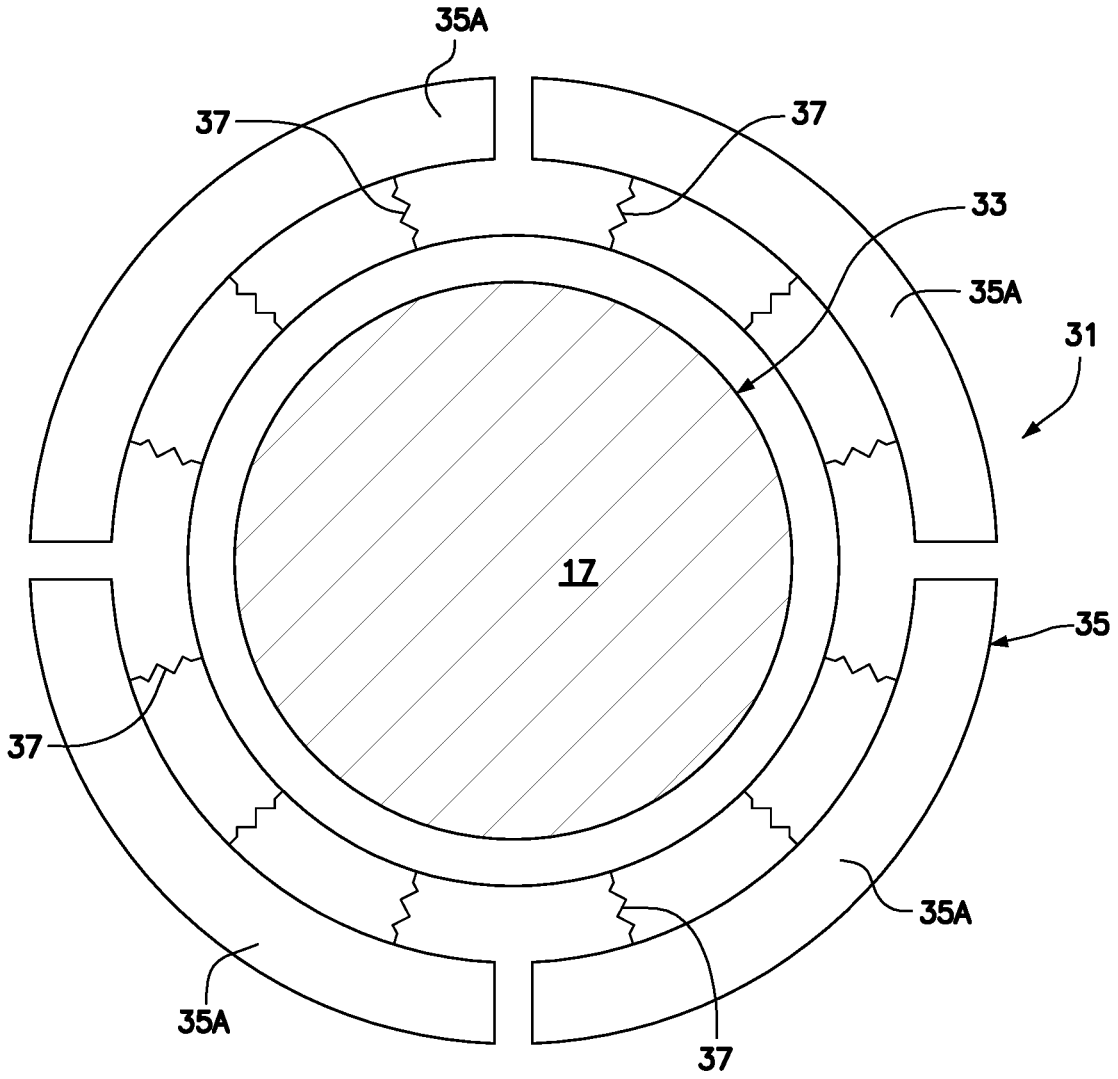
FIG. 3 is a schematic cross-sectional view according to line III-III of FIG. 2.

In the embodiment of FIG. 1, the intermediate support member 31 is located at the level of the fourth impeller starting from the first gas inlet 5 (i.e., from the left in FIG. 1). FIG. 2 illustrates an enlargement of the portion of rotor 13, where the intermediate support member 31 is located. FIG. 3 illustrates a schematic functional cross-sectional view of the intermediate support member 31 and of the tie rod 17 according to line III-III in FIG. 2.

As shown in FIG. 3, in some embodiments the intermediate support member 31 comprises an inner annular component 33 and an outer annular component 35. The inner annular component 31 is mounted on the tie rod 17 such as to rotate therewith. For instance, the inner annular component 31 can be press-fit or keyed on the tie rod 17.

Specifically, the inner annular component 33 can be press-fit or keyed on an intermediate section 17C of the tie rod 17. To facilitate insertion and fitting of the intermediate support member 31, the tie rod 17 can have a first side section extending from the first axial end 17A to the intermediate section 17C and a second side section extending from the second axial end 17B to the intermediate section 17C. The intermediate section 17C can have a diameter which is slightly larger than the diameter of the first side section and/or of the second side section.

In some embodiments, the inner annular component 33 is a one-piece annular member, while the outer annular component 35 is divided into a plurality of annular segments 35A, which are separated from one another by respective gaps. In the embodiment of FIG. 3, the outer annular component 35 is divided into four annular segments 35A. It shall be understood that the number of annular segments can be different. For instance, in some embodiments there may be provided two, three or more than four annular segments 35A.

The inner annular component 33 is coupled to the outer annular component 35 by means of resilient members 37, arranged in an annular gap between the inner annular component 33 and the outer annular component 35. More specifically, each single annular segment 35A of the outer annular component 35 is resiliently connected to the inner annular component 33 though one or more resilient member 37.

In some embodiments, the inner annular component 33, the outer annular component 35, i.e., the annular segments 35A thereof, and the resilient members 37 can be manufactured as a monolithic machine component. In some embodiments, for instance, the inner annular component 33, the annular segments 35A and the resilient members 37 can be produced by additive manufacturing.

In other embodiments, the intermediate support member 31 can be formed by separate components assembled together.

At rest, the outer diameter of the outer annular component 35 is slightly smaller than the inner diameter of the bore of the impeller 15 in which the intermediate support member 31 is housed.

When the rotor 13 rotates around the rotation axis A-A, the centrifugal force acting on the annular segments 35A forming the outer annular component 35 elongates the resilient members 37 until each annular segment 35A of the outer annular component 35 comes to rest and press on the inner surface of the through bore of the impeller 15 housing the intermediate support member 31. The resilient members 37 and the annular segments 35A of the outer annular component 35 are configured such that the rotational speed at which the annular segments 35A contact the inner surface of the through bore of the impeller 15, in which the intermediate support member 31 is housed, is substantially lower than the first resonant frequency of the tie rod 17.

When the compressor 1 is driven into rotation, the annular segments 35A will expand and provide an intermediate support constraint for the tie rod 17, causing a stiffening thereof and a consequent increase of the first critical speed, i.e., the first resonant frequency, of the tie rod 17. The first critical speed becomes higher than the operational speed of the compressor 1, i.e., higher than the rotational speed of the rotor 13.

In advantageous embodiments, the characteristics of the resilient members 37 can be such that the outer annular component 35 engages with the impeller 15 at a rotational speed which can be, for instance, equal to or lower than 70% of the nominal rotational speed of the compressor 1, for instance between 40% and 60% of said nominal compressor speed or of the minimum speed of an operational speed range of the compressor 1.

In some embodiments, as shown in FIG. 2, the intermediate support member 31 is housed in the impeller eye of the respective impeller 15, since the impeller eye is the impeller portion that is less deformed by the centrifugal force generated by rotation of the rotor.

Figure 4:
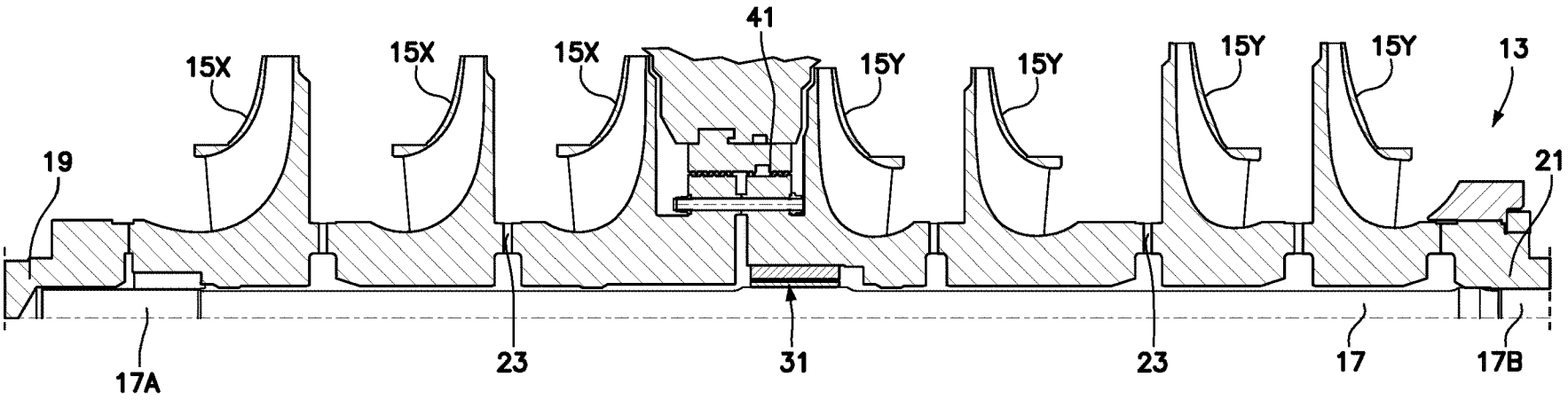
FIG. 4 is a sectional view of a rotor of a centrifugal compressor according to another embodiment.

In FIG. 1 the compressor 1 includes a plurality of in-line impellers. In other embodiments, the compressor may have a back-to-back impeller configuration. An exemplary embodiment of a back-to-back configuration is shown in FIG. 4, in which only the rotor is shown. The same or equivalent components are labeled with the same reference numbers used in FIGS. 1 and 2 and are not described again.

More specifically, the compressor rotor 13 of FIG. 4 includes seven impellers, which are divided into two sections. Three impellers 15X are shown on the left side of the rotor 13 and four impellers 15Y are shown on the right side of the rotor. The impellers 15X are arranged with the impeller eyes and the impeller inlets facing the left end of the rotor 13, and the impellers 15Y are arranged with the impeller eyes and the impeller inlets facing the right end of the rotor 13.

Figure 5:
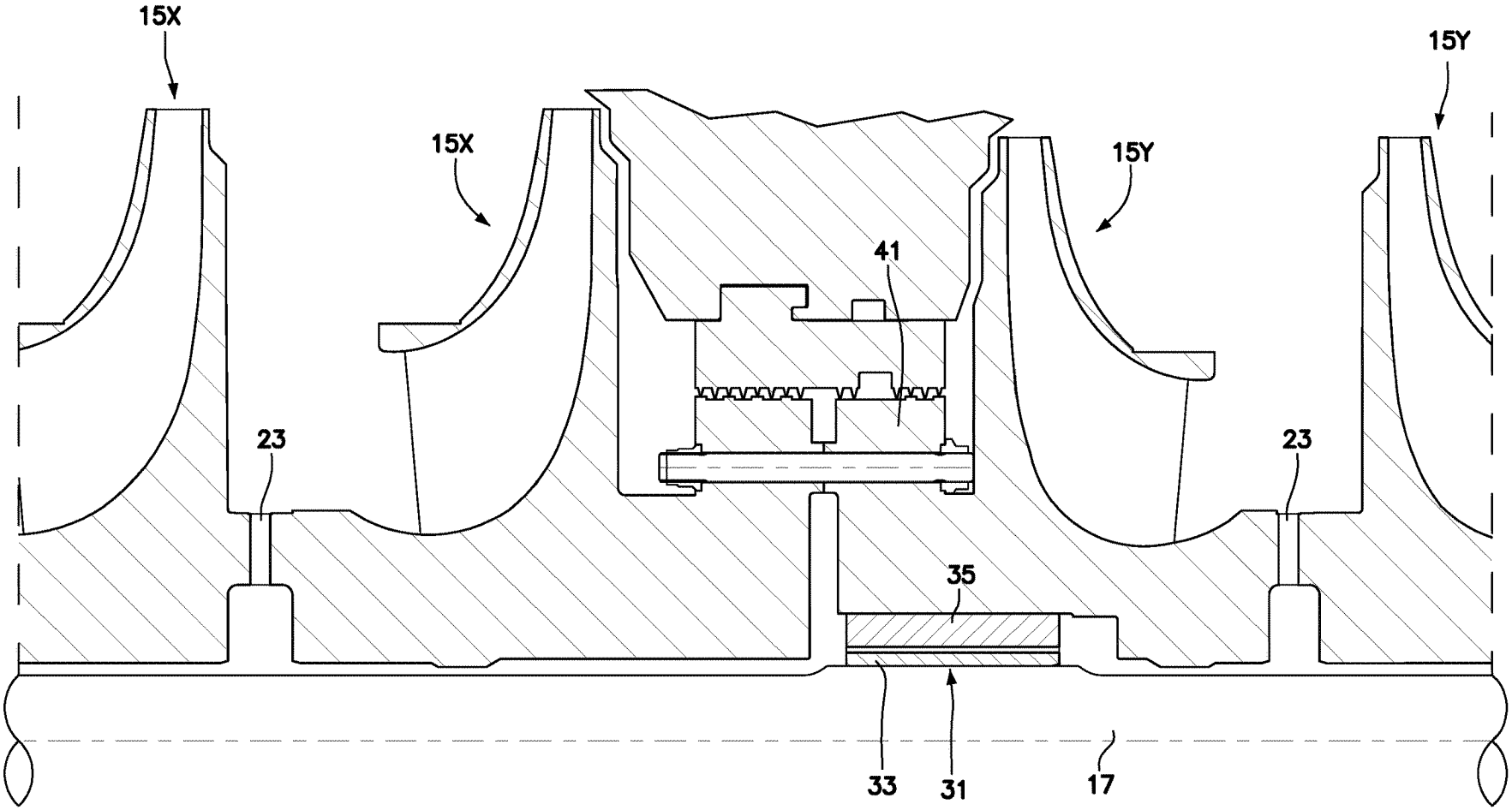
FIG. 5 is an enlarged detail of FIG. 4.

An interphase drum 41 is positioned between the two groups or sets of impellers 15X and 15Y (see in particular FIG. 5). In the embodiment of FIGS. 4 and 5, the interphase drum 41 is in actual fact formed by two portions of the two intermediate adjacent impellers 15X, 15Y facing each other. In other embodiments, the interphase drum can be provided as a separate additional rotor segment, arranged between the last impeller 15X and the last impeller 15Y and coupled thereto by front couplings, such as Hirth couplings.

In the embodiment of FIGS. 4 and 5, the intermediate support member 31 is arranged in the portion of the impeller 15Y forming part of the interphase drum 41. In other embodiments, the intermediate support member 31 can be positioned in the portion of the adjacent impeller 15X.

While in the above-described embodiments a single intermediate support member 31 is provided, in other embodiments two or more intermediate support members 31 can be located in suitably distanced positions along the axial extension of the tie rod 17, between the two opposite axial ends 17A, 17B thereof.

When at least one intermediate support member 31 is arranged between the tie rod 17 and one of the rotor segments, for instance an impeller or an interphase drum, the first critical speed of the tie rod can be significantly increased with respect to an un-supported tie rod. The other parameters being the same, using at least one intermediate support member can result in an increase of the first critical speed to 150% of the critical speed of the unsupported tie rod.

The advantages achieved with the intermediate support member(s) 31 are two-fold: on the one side a longer tie rod can be used, which means that a larger number of impellers can be provided in a single compressor. A larger number of impellers allows achieving a higher compression ratio. Moreover, shifting the critical speed to substantially higher values, allows the compressor to operate at higher rotational speeds, which is again beneficial in terms of achievable compression ratios.

Intermediate support members are particularly beneficial if used in compressors for processing a gas of low molecular weight, such as hydrogen, requiring high rotational speeds.

Exemplary embodiments have been disclosed above and illustrated in the accompanying drawings. It will be understood by those skilled in the art that various changes, omissions and additions may be made to that which is specifically disclosed herein without departing from the scope of the invention as defined in the following claims.

The invention claimed is:

1. A rotor for a turbomachine, comprising:

a plurality of rotor segments arranged axially adjacent to one another, each rotor segment including a central through bore;

a tie rod extending through the through bores of the rotor segments, the tie rod having opposite first axial end and second axial end;

a first stub shaft and a second stub shaft arranged at the first axial end and second axial end of the tie rod, each coupled to the tie rod so as to lock the rotor segments to one another and to the tie rod; and at least one intermediate support member arranged in an intermediate position between the first axial end and the second axial end of the tie rod and between the tie rod and one of the rotor segments;

wherein the intermediate support member comprises an inner annular component coupled to the tie rod and rotating therewith, and an outer annular component adapted to co-act with said one rotor segment;

wherein the outer annular component comprises a plurality of annular segments, each annular segment being coupled to the inner annular component by at least one resilient member arranged between the inner annular component and the annular segment; and wherein the inner annular component, the annular segments of the outer annular component and the resilient members are formed as a monolithic machine component, wherein at rest, the outer diameter of the outer annular component is smaller than an inner diameter of a bore of the rotor segment, in which the intermediate support member is housed, wherein when the rotor is driven into rotation, the annular segments expand under the effect of centrifugal force acting thereon and provide an intermediate support constraint for the tie rod, causing a stiffening thereof and a consequent increase of the first resonant frequency of the tie rod, and wherein the characteristics of the resilient members are such that the annular segments engage with the bore of the rotor segment at a rotational speed equal to or lower than 70% of the nominal rotational speed of the rotor.

2. The rotor of claim 1, wherein each annular segment is mechanically decoupled from the adjacent annular segments.

3. The rotor of claim 1, wherein the inner annular component and the annular segments are formed as a single body by additive manufacturing.

4. The rotor of claim 1, wherein the tie rod comprises an intermediate section, a first side section extending from the first axial end to the intermediate section and a second side section extending from the second axial end to the intermediate section; wherein the intermediate section has a diameter larger than a diameter of at least one of said first side section and second side section and the at least one intermediate support member being locked to the tie rod at said intermediate section.

5. The rotor of claim 1, wherein the rotor segments include centrifugal compressor impellers, and wherein the intermediate support member is arranged in a central through bore of one of said centrifugal compressor impellers.

6. The rotor of claim 1, wherein the rotor segments include a first set of centrifugal compressor impellers and a second set of centrifugal compressor impellers;

wherein the first set of centrifugal compressor impellers and the second set of centrifugal compressor impellers are arranged in a back-to-back configuration;

wherein the rotor segments further include an interphase drum arranged between the first set of centrifugal compressor impellers and the second set of centrifugal compressor impellers; and wherein the intermediate support member is arranged in a central through bore of the interphase drum.

7. The rotor of claim 1, further comprising a first stub shaft at the first axial end of the tie rod and a second stub shaft at the second axial end of the tie rod.

8. A turbomachine including a casing and a rotor according to claim 1, arranged for rotation in the casing.

9. The turbomachine of claim 8, wherein the turbomachine is a compressor.

10. The turbomachine of claim 8, wherein the turbomachine is a centrifugal compressor.

* * * * *